US005924146A

United States Patent [19]

Ruiz Elosegui

[11] Patent Number: 5,924,146

[45] Date of Patent: Jul. 20, 1999

[54] BATHTUB ON BED FOR IMMOBILE PATIENTS

[76] Inventor: Julian Ruiz Elosegui, Arda. Murrieta, 2-4° Deha., Santurce, Spain

[21] Appl. No.: 08/737,907

[22] PCT Filed: Feb. 1, 1996

[86] PCT No.: PCT/ES96/00019

§ 371 Date: Nov. 26, 1996

§ 102(e) Date: Nov. 26, 1996

[87] PCT Pub. No.: WO96/24321

PCT Pub. Date: Aug. 15, 1996

[30] Foreign Application Priority Data

Jul. 2, 1995 [ES] Spain ..... 9500341 U

[51] Int. Cl.[6] ..... A47K 3/022

[52] U.S. Cl. ..... 4/538; 4/540; 4/589

[58] Field of Search ..... 4/538, 516, 518, 4/572.1, 571.1, 573.1, 575.1, 587, 589, 540

[56] References Cited

U.S. PATENT DOCUMENTS

| | | | |
|---|---|---|---|
| 3,559,216 | 2/1971 | Kyte | 4/540 |
| 3,800,336 | 4/1974 | Hoxeng | 4/587 |
| 3,822,421 | 7/1974 | Loren | 4/575.1 |
| 4,074,370 | 2/1978 | Harmony, III | 4/575.1 |
| 4,583,252 | 4/1986 | McCourt | 4/538 |

FOREIGN PATENT DOCUMENTS

| | | | |
|---|---|---|---|
| 15396 | 6/1910 | United Kingdom | 4/584 |
| 2220565 | 1/1990 | United Kingdom | 4/589 |
| 2279562 | 1/1995 | United Kingdom | 4/584 |
| 94/18930 | 9/1994 | WIPO | 4/584 |

*Primary Examiner*—Charles R. Eloshway
*Attorney, Agent, or Firm*—Alfred M. Walker

[57] ABSTRACT

An on-bed bath for bedridden patients made up of a flat tray sized to accommodate a patient with raised sides at a slight angle. A U-shaped anti-splattering member is attached with quick fasteners to the insides of the raised sides. The tray is provided with a drain for emptying the tray of water. A mattress is placed in the tray for the comfort of the patient. The method of bathing the patient involves rolling the patient into the tray and then attaching the anti-splattering member.

1 Claim, 7 Drawing Sheets

BATHTUB ON BED FOR IMMOBILE PATIENTS

The present invention, as expressed below, refers to an on-bed bath for bedridden patients which has been designed and developed in order to obtain a bath for people who cannot move from their beds, offering several important advantages if compared with present alternatives.

The bath is designed for patients who, for different reasons, cannot get up from bed and are staying in places such as hospitals, clinics, sanatoriums, geriatric residences, institutions, private homes, hotels, etc. These persons can thus enjoy a complete bath without having to be moved to the bathtub in the bathroom or to any other assisted bath system.

INVENTION BACKGROUND

There is not at present any device to bathe people on their beds like the one we are dealing with. The usual way of bathing people on their beds is carried out with a washing basin and a sponge with the risk of wetting the bedding and leaving the patient unsatisfied and half-washed. The patient can alternatively be moved to the bathroom for a complete bath but this can cause many problems and it is never relaxing for the patient.

INVENTION DESCRIPTION

Generally speaking, the special bath for bedridden patients, which is the object of the invention, is built with the dimensions and a number of components and the type of materials to achieve the best conditions for the function it has been designed to cover, that is, a gratifying and relaxing bath without being moved from the bed.

It is composed of a flat tray which is the base of the bath , the tray bending slightly at the sides forming a kind of side wall with the right inclination to allow the body to be accommodated onto the tray.

At an upper side of the tray there is a hole to where a special elbow for drainage is adjusted. The elbow is fixed with a stainless steel countersunk-head bolt to the drain cover so that it does not stick out.

To the side wall of the tray , the anti-spattering protections should be fixed. The fixation is easily done and undone through the corresponding fittings.

A flat mattress with a sewn-in pillow or neckroll is then put on the tray so that the patient lies more comfortably on the bath. This mattress is made of a sanitary material.

Other components of the bath are: a cold-hot water mixer, a thermometer, an outlet to join the hose of the desired length and at the end of the hose there is a valve that closes in the portable shower head.

Finally there is a drainage hose, made of a flexible plastic, connected to the elbow from the base of the bath that empties the bath water into a tank. Two tanks instead of one can be used to lengthen the bathing time.

The anti-spattering protections are fixed to the sides of the tray with a pin that goes through the corresponding holes. A crossing split pin does not let the pin move.

In order to ease the understanding of the invention and as a part of the descriptive memory, you can find attached, the plans of the invention that are thought to be illustrative rather than restrictive:

DESCRIPTION OF THE OPERATION

Figure 1:
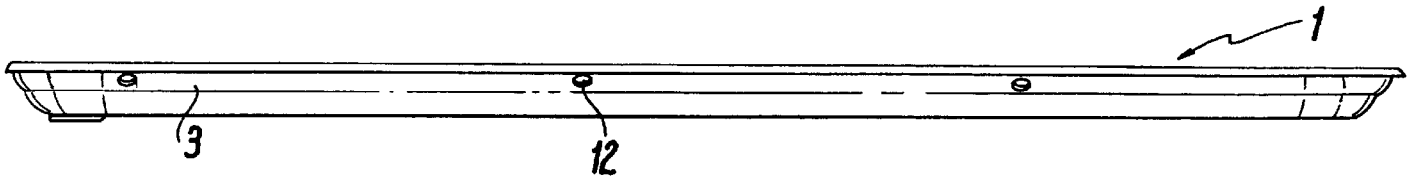
FIG. 1. It is a longitudinal elevation view of the bath for bedridden patients.
Figure 2:
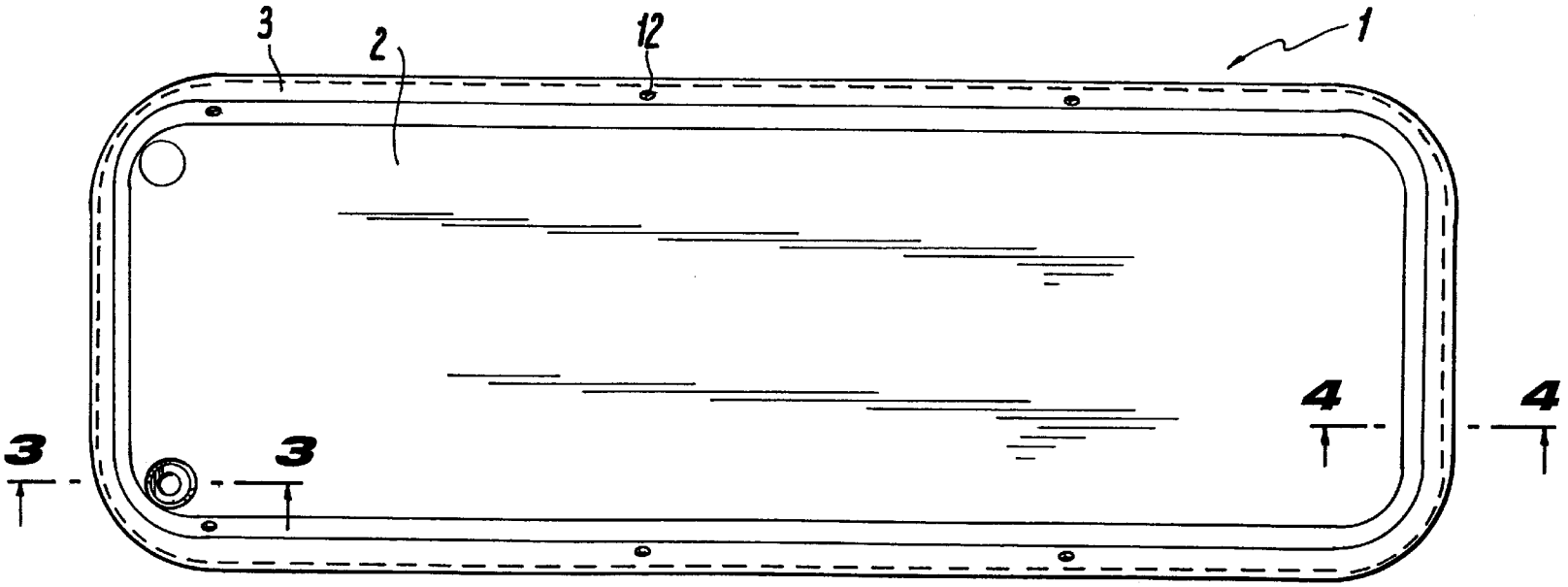
FIG. 2. It is a plan view of that shown in FIG. 1.
Figure 3:
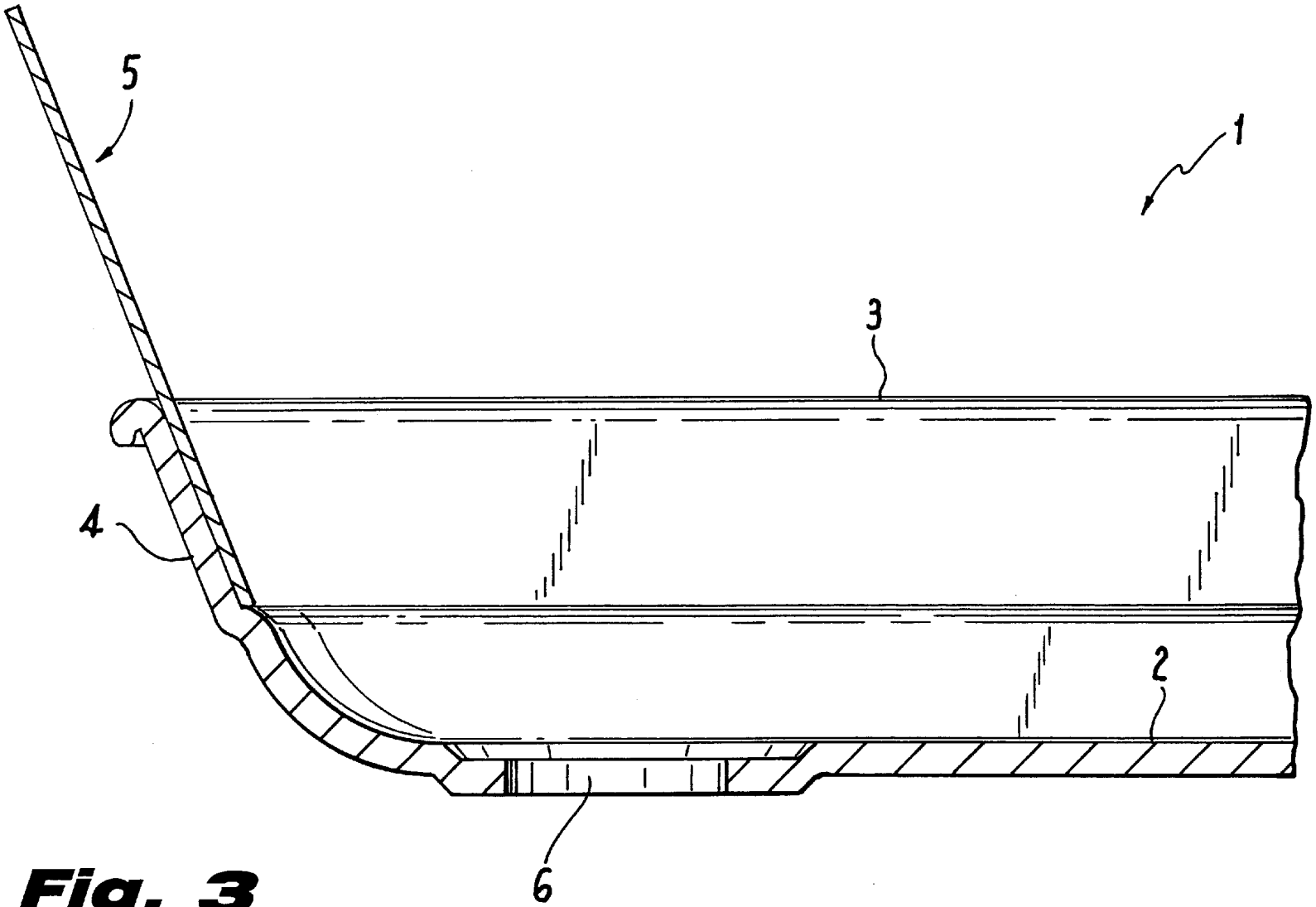
FIG. 3. It is a cross section of the axis III—III of FIG. 2.

According to the numbers given in the figures we can see that the on-bed bath for bedridden patients includes a base or tray 1 with a flat bottom 2 and a short side wall 3 and a parallel outwards treading 4 where the side protections 5 are fixed .

Figure 8:
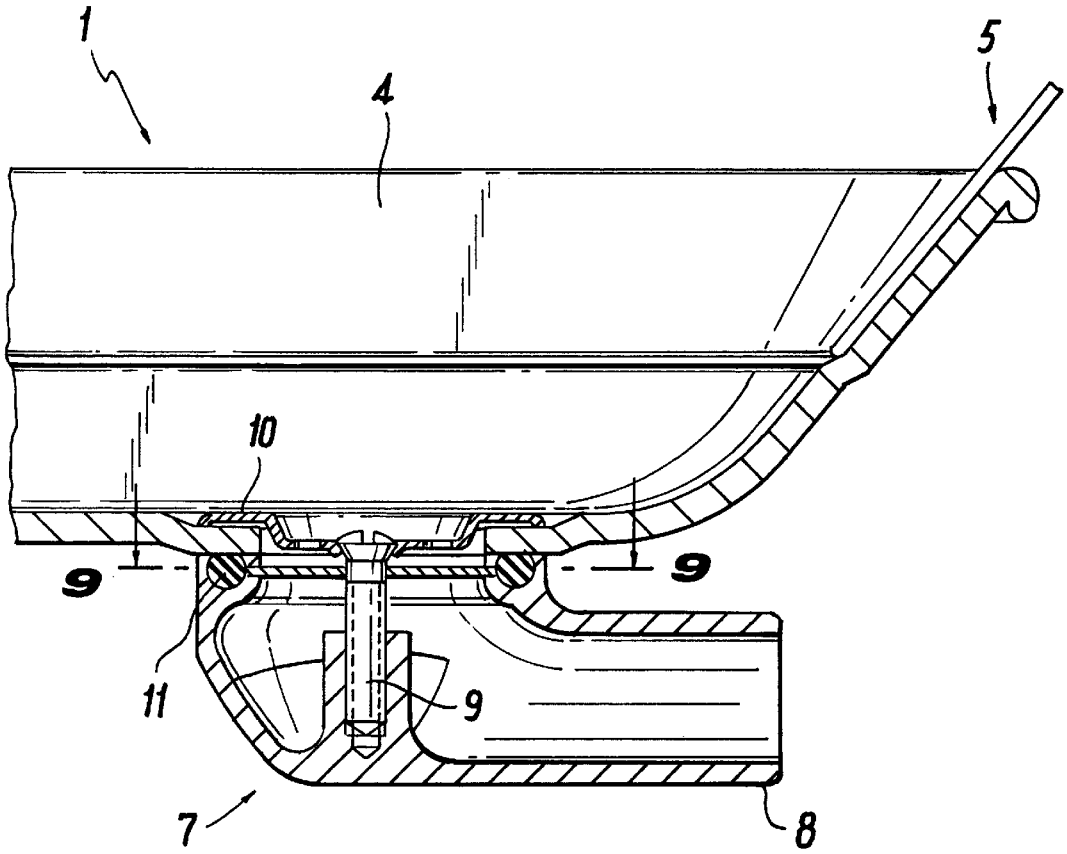
FIG. 8. It is a partial view, cross-sectioned, of the part of the bath next to the drainage valve.
Figure 9:
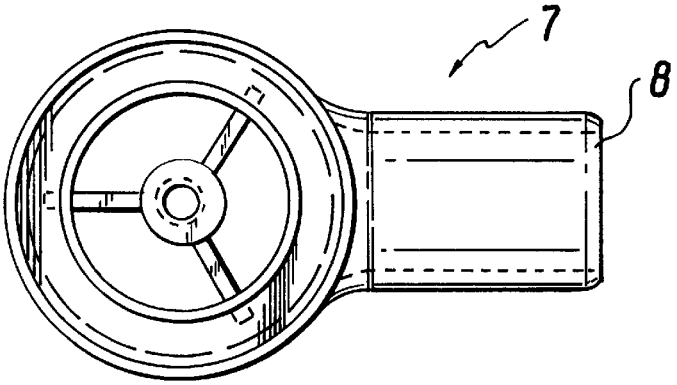
FIG. 9. It is a cross section of the axis IX—IX of FIG. 8.

The bottom of the tray 2 has a pantile that is thought to make the drainage easier, with a hole 6, to which the drainage valve 7 is fixed (see FIG. 8) with a side nozzle 8 that is the insertion point of a flexible hose that goes to the drainage tank. This special drainage elbow is fixed with a spin to the transverse axis of the drain cover 10, with a washer.

Figure 4:
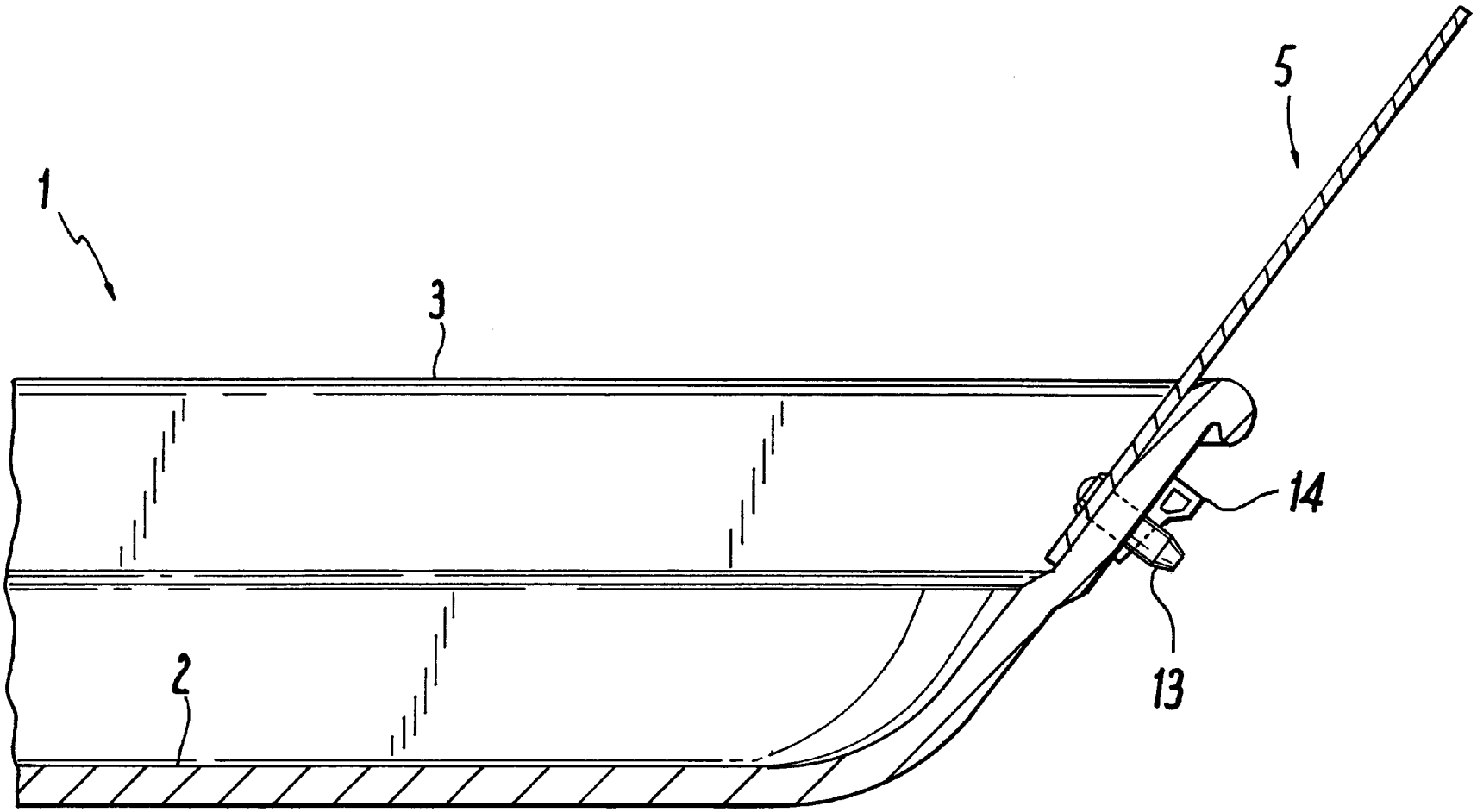
FIG. 4. It is a cross section of the axis IV—IV of FIG. 2.
Figure 5:
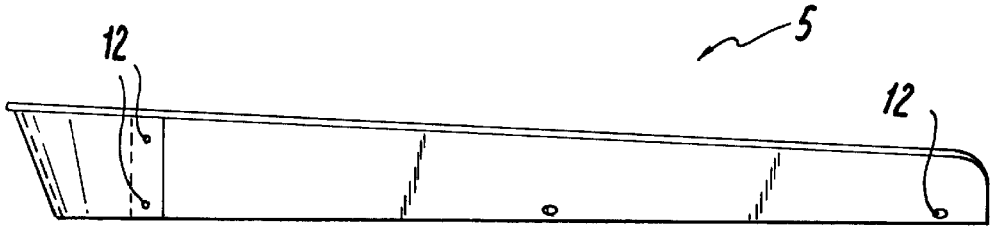
FIG. 5. It is a longitudinal elevation view of the anti-spattering side protections.
Figure 7:
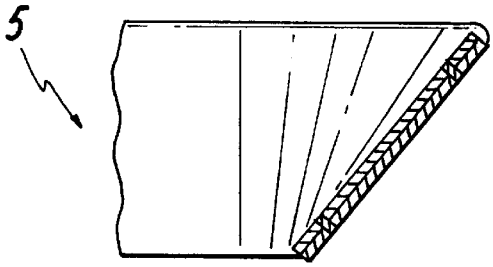
FIG. 7. It is a cross section of the axis VII—VII of FIG. 6.

In FIGS. 5 and 7 we can see the anti-spattering side protections 5 that have three parts forming a U-shaped piece that can be adapted both to the upper and to the lower part of the tray and fixed to the border 4 of the side wall of the tray because there are two small holes 12 where to introduce the corresponding pins 13 and fixing split pins 14. The mounting of these pins and split pins can be clearly seen in FIG. 4.

Figure 6:
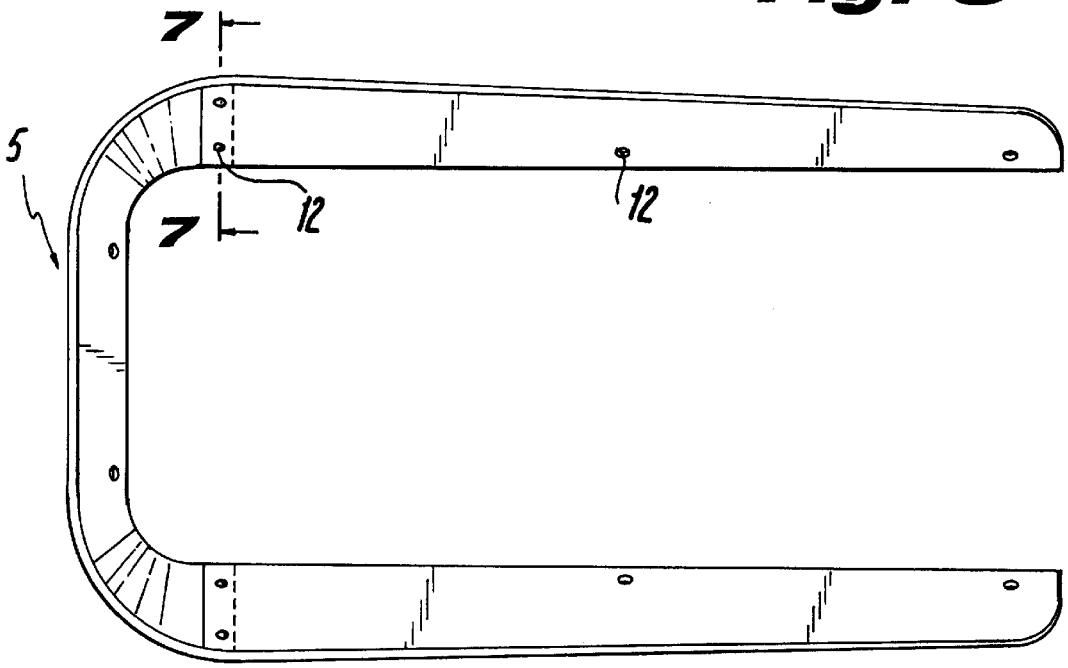
FIG. 6. It is a plan view of that shown in FIG. 5.

The three parts that form the U-shaped side protections 5 are treaded with other pins and split pins similar but shorter to the ones referred in 13 and 14 respectively . In FIGS. 5 and 6 we can see that we need a pair of quick fittings for each treading zone of the side protections 5.

In the FIGS. 12 to 15 we can see at a larger scale the shape of the pins 13 and split pins 14. Through the transverse opening 15 of the pin 13, where the bended side is determined 16, the end of split spin 14 is introduced, so that the fixing is perfect as we press slightly to introduce the split spin. Reference number 17 refers to the pantiles that the head of the split spin 14 has to make the handling easier.

Figure 10:
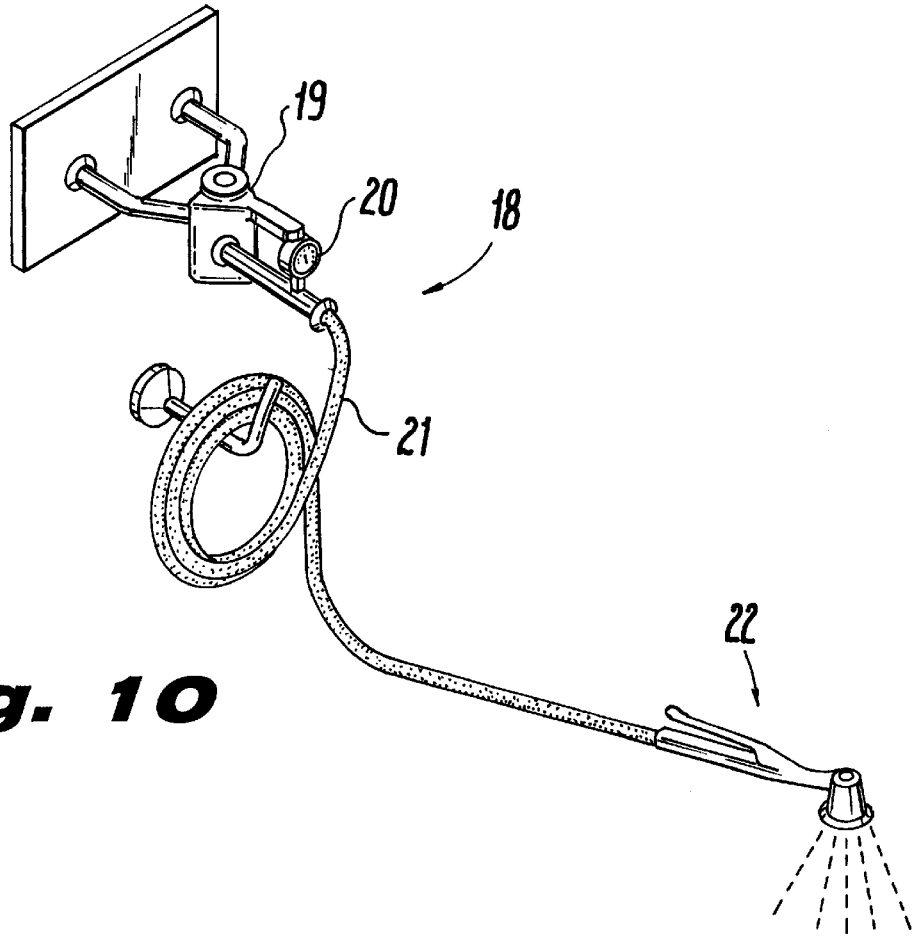
FIG. 10. It is a drawing of the cold-hot water mixer with the hose and the hand of the shower head.

In FIG. 10 we have referred to the equipment that supplies water 18 that is composed of a head 19 from the water supply , thermometer 20, hose 21 and shower head valve 22.

Figure 11:
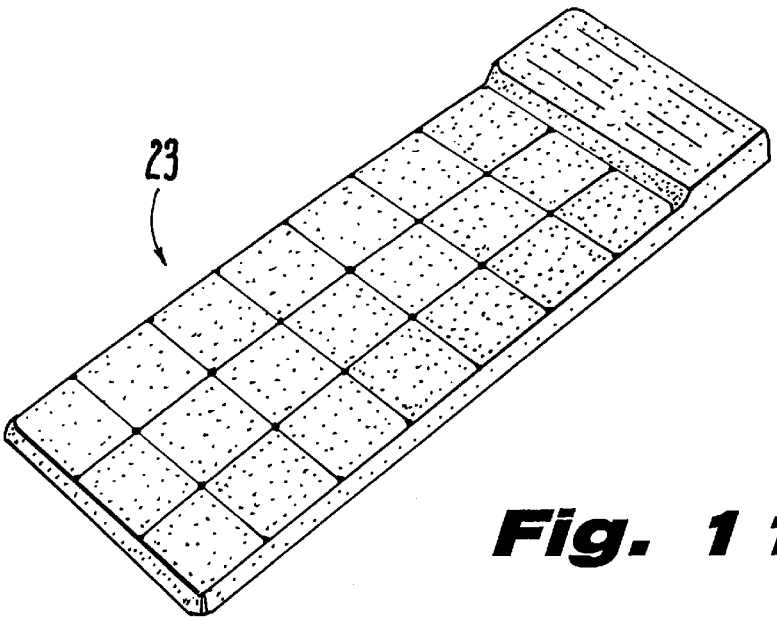
FIG. 11. It is a drawing of the mattress that is placed on the tray.
Figure 12:
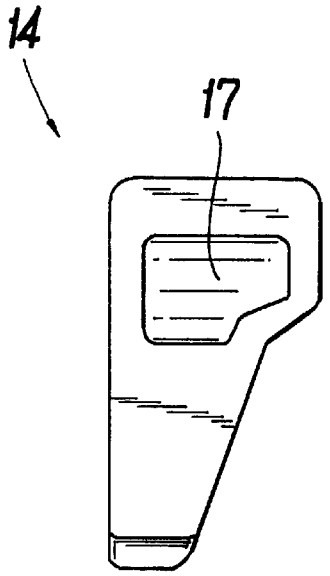
FIG. 12 and 13. These are plan view and longitudinal section of one of the split pins of the fittings that fix the side protections to the tray.
Figure 13:
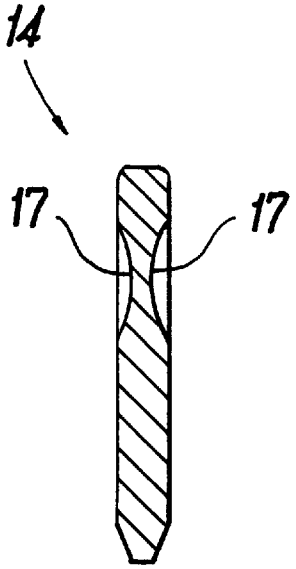
Figure 14:
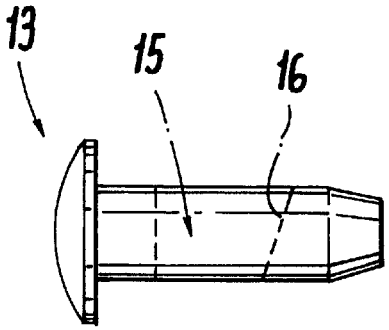
FIG. 14 and 15. These are two views (90 degree spin) of details of the fittings where the split pins are inserted.
Figure 15:
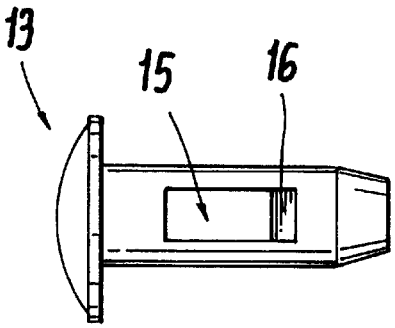

In FIG. 11 we can see the mattress 23 onto where the patient lies to make it more comfortable.

In this way the bath is better for the patient because we can regulate the head 19 and control the temperature of the water, moving the hose 21 with the shower head 22 to the point where the bath is and the tray I to the side of the bed.

Afterwards we make the patient ready, undressing and turning them on their sides so that the tray I with the mattress 23 can be introduced at a 45° angle. Then we have to let the patient lie back to a horizontal position as the tray lies back as well to a horizontal position on the bed. It is time then to adjust the side protections 5 and to connect the flexible hose (not represented in the figures) to the drainage tank.

With the shower head, once the pressure and temperature of the water flow has been adjusted as desired, we can achieve the gratifying and relaxing bath. Afterwards we will have to rinse and dry the patient as the remaining water flows from the tray to the tank before taking the patient back to the bed through a process which is inverse to the one described to introduce them onto the tray.

I claim:

1. The method of bathing a patient in his bed comprising the steps of:

a) rolling said patient into a flat tray on said bed tipped to receive said patient, said tray sized to contain said patient and bending slightly along the perimeter thereof forming flat raised sides with an inclination which allows the body to be accommodated into said tray as said tray is tipped, said tray having a drain for withdrawing water after said bath, and a mattress within said tray for the comfort of said patient while bathing;

b) mounting U-shaped quick connecting means on and surrounding three of said raised sides after said patient is placed within said tray for preventing splattering of said water within said tray, said quick connecting means overlapping said raised sides on the inside of said tray and attached to said raised sides by inserting cylindrical pins through matching holes in said quick connecting means and said raised sides and inserting flat split pins through slotted openings in said cylindrical pins, thereby making it easy and convenient to mount and remove said quick connecting means;

c) placing water into said tray using a shower head, cold-hot water mixer and a thermometer to control water temperature;

d) bathing said patient;

e) draining the water out of said tray through said drain; and f) removing said quick connecting means.

* * * * *